United States Patent [19]

Matsuda

[11] Patent Number: 4,583,958

[45] Date of Patent: Apr. 22, 1986

[54] TOY GUN/ROBOTIC-HUMANOID ASSEMBLY WITH BULLET PROPELLING APPARATUS

[75] Inventor: Takashi Matsuda, Tokyo, Japan

[73] Assignee: Takara Co., Ltd, Tokyo, Japan

[21] Appl. No.: 584,459

[22] Filed: Feb. 28, 1984

[30] Foreign Application Priority Data

Mar. 18, 1983 [JP] Japan ..... 58-39148[U]
Mar. 18, 1983 [JP] Japan ..... 58-39149[U]

[51] Int. Cl.[4] ..... A63H 13/10; A63H 3/46; A63H 33/30

[52] U.S. Cl. ..... 446/308; 446/376; 446/473; 446/487; 124/27

[58] Field of Search ..... 446/85, 97, 99, 72, 446/473, 268, 320, 376, 487, 308, 309; 124/16, 27

[56] References Cited

U.S. PATENT DOCUMENTS

| | | | |
|---|---|---|---|
| 3,453,774 | 7/1969 | Breneman et al. | 446/353 |
| 3,938,277 | 2/1976 | Goldfarb et al. | 446/384 |
| 3,946,517 | 3/1976 | Goldfarb et al. | 446/383 |
| 4,103,451 | 8/1978 | Kawada et al. | 446/99 |
| 4,125,961 | 11/1978 | Yamashina | 446/308 |
| 4,150,508 | 4/1979 | Ogawa | 446/473 X |
| 4,206,564 | 6/1980 | Ogawa | 446/99 X |
| 4,391,060 | 7/1983 | Nakane | 446/97 X |
| 4,411,097 | 10/1983 | Murakami | 446/376 |

*Primary Examiner*—Mickey Yu
*Attorney, Agent, or Firm*—Price, Gess & Ubell

[57] ABSTRACT

A toy assembly that can be converted into either a toy gun or robotic humanoid assembly is provided. A handle member can be reconfigured to simulate the robotic legs, while the gun barrel member can be reconfigured to simulate the robotic arms. A trigger frame assembly can be positioned adjacent the handle member and the gun barrel member when simulating the configuration of a gun or can be rotated when simulating a robot. The configuration of a toy gun can fire actual pellets.

20 Claims, 6 Drawing Figures

TOY GUN/ROBOTIC-HUMANOID ASSEMBLY WITH BULLET PROPELLING APPARATUS

BACKGROUND OF THE INVENTION

1. Field of the Invention

The present invention relates to a toy gun/robotic-humanoid assembly with a bullet propelling apparatus and, more particularly, to a toy gun/robotic-humanoid assembly which forms a toy gun when folded, and is reconfigured into a toy robotic-humanoid when unfolded.

2. Description of the Prior Art

Hitherto, such a reconfigurable toy assembly has been known that is adapted to be reconfigurable into different kinds of shape through a combination of block members. However, if such a toy assembly is complicated in construction so as to allow a unique structure to be enjoyed, the toy assembly frequently becomes difficult for infants to handle. On the other hand, if the construction is simplified, the toy becomes monotonous, which also makes it difficult to interest infants therein. In addition, any loss of the block members makes it impossible to form a predetermined shape, and it becomes are troublesome to take care that any of the block members is not lost. Thus, the conventional reconfigurable toy asssembly is unfavorable for infants.

SUMMARY OF THE INVENTION

It is an object of the present invention to provide a toy gun/robotic-humanoid assembly which forms a toy gun when folded and is reconfigured into a toy robotic humanoid when unfolded, the toy gun/robotic-humanoid assembly comprising: a trunk of the toy robotic humanoid which constitutes the central portion of the gunbarrel of the toy gun when the assembly is folded; a head of the toy robotic humanoid which is provided on the upper side of the trunk and is housed within the trunk when the assembly is folded; right and left arms of the toy robotic humanoid which are rotatably as well as extendably mounted on the right and left sides of the trunk and constitute the front and rear portions of the gunbarrel of the toy gun, respectively, when the assembly is folded; a waist unit of the toy robotic humanoid which is pivotally provided at the lower end of the trunk and constitutes a trigger portion of the toy gun when the assembly is folded; legs of the toy robotic humanoid which are pivotally mounted on the lower end of said trunk and together constitute a grip of the toy gun when the assembly is folded; and feet of the toy robotic humanoid which are pivotally provided at the lower ends of the legs and are folded into the legs of the toy gun when the assembly is folded.

Another object of the invention is to provide a bullet-propelling apparatus for the toy gun/robotic-humanoid assembly wherein one of the lower arm portions has a muzzle which is formed so that a toy bullet can fit therein, and a lever device which locks the toy bullet so that the bullet can be propelled by an external operation, and wherein an interlocking device actuates the lever device while interlocking with the trigger device, is provided between the lever device and trigger device, so that the bullet-propelling apparatus is constituted of the interlocking device, trigger device and lever device.

The object and features of the present invention which are believed to be novel are set forth with particularity in the appended claims. The present invention, both as to its organization and manner of operation, together with further objects and advantages thereof, may best be understood by reference to the following description, taken in connection with the accompanying drawings.

DETAILED DESCRIPTION OF THE PREFERRED EMBODIMENT

An embodiment of the invention will be described hereinunder in detail with reference to the accompanying drawings.

Figure 1:
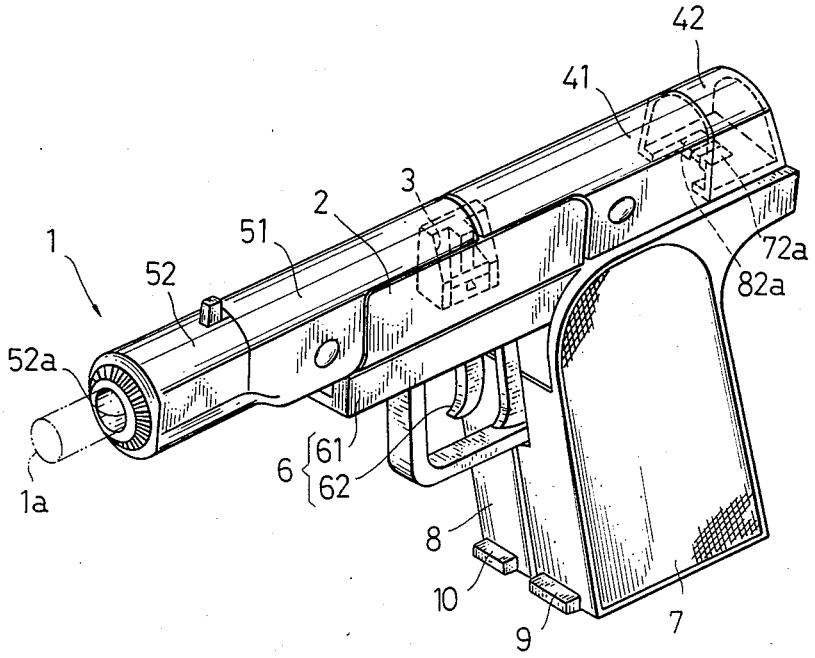
FIG. 1 is a perspective view of an embodiment of the present invention forming a configuration of the toy gun with the various parts thereof folded.
Figure 2:
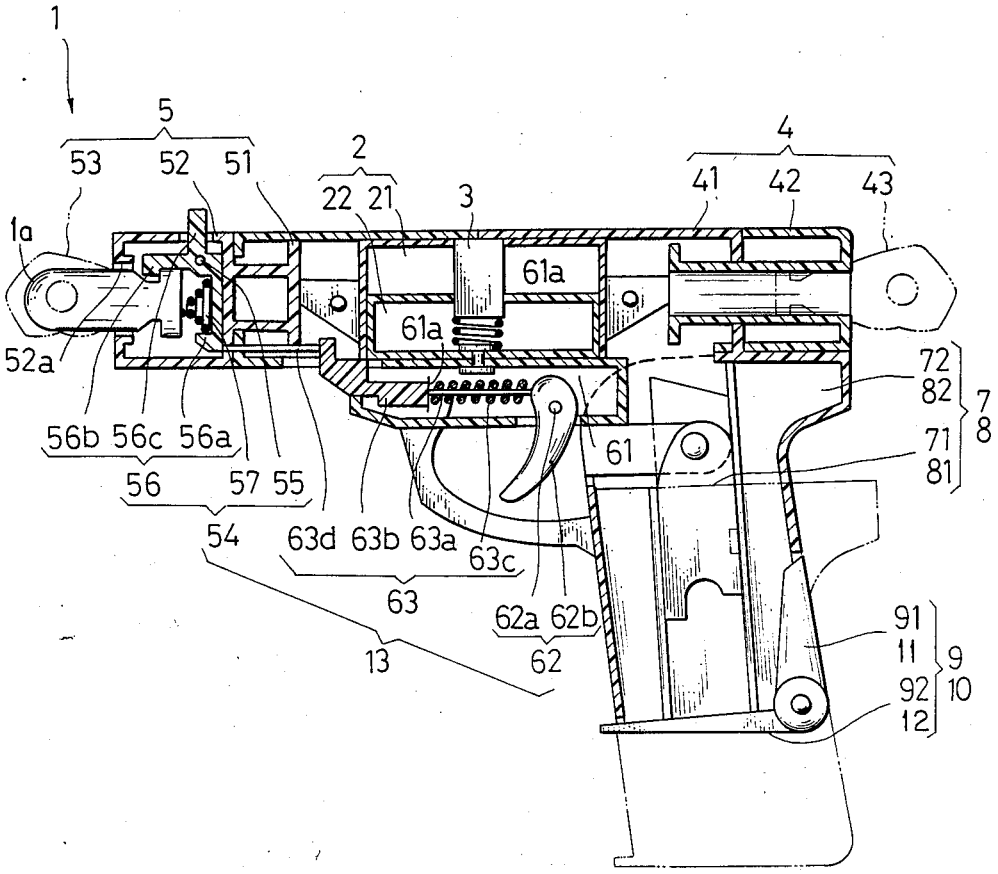
FIG. 2 is a longitudinal sectional view of the embodiment of FIG. 1 showing the bullet-propelling apparatus thereof before the bullet is propelled.
Figure 3:
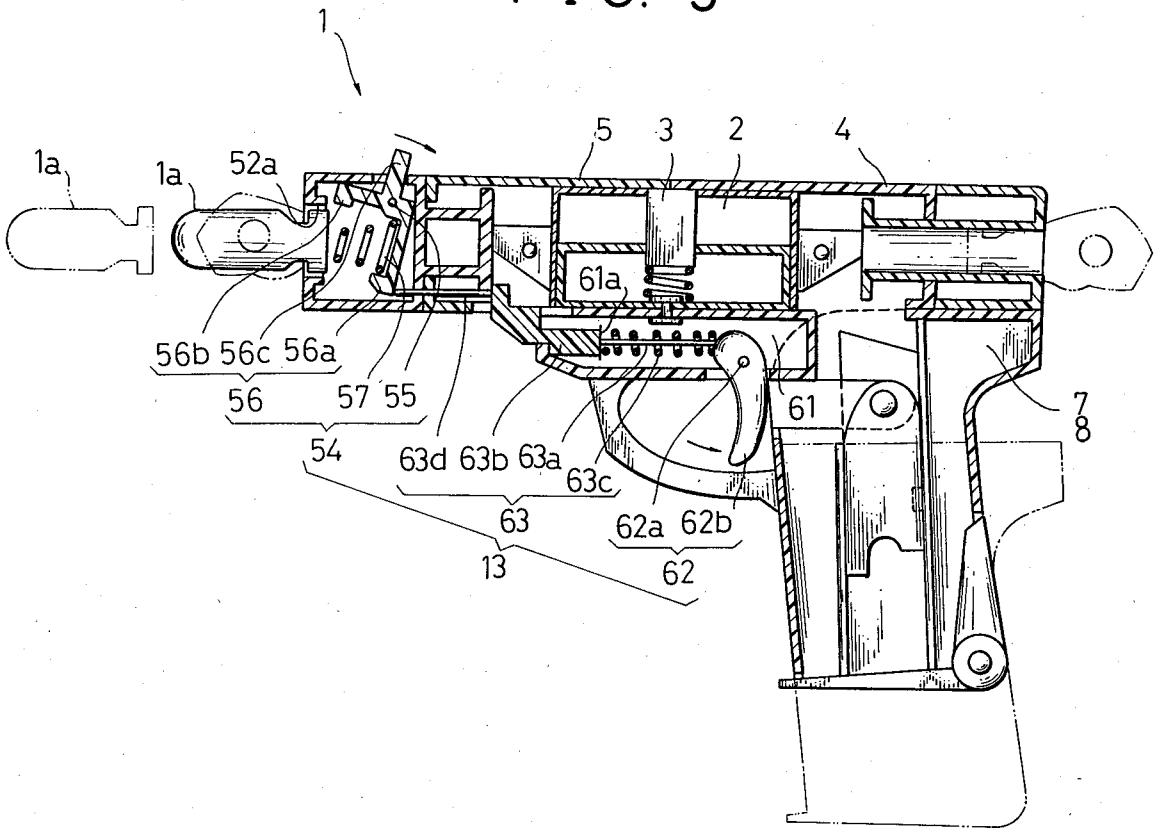
FIG. 3 is a longitudinal sectional view of the embodiment of FIG. 1 showing the bullet-propelling apparatus thereof after the bullet is propelled.
Figure 4:
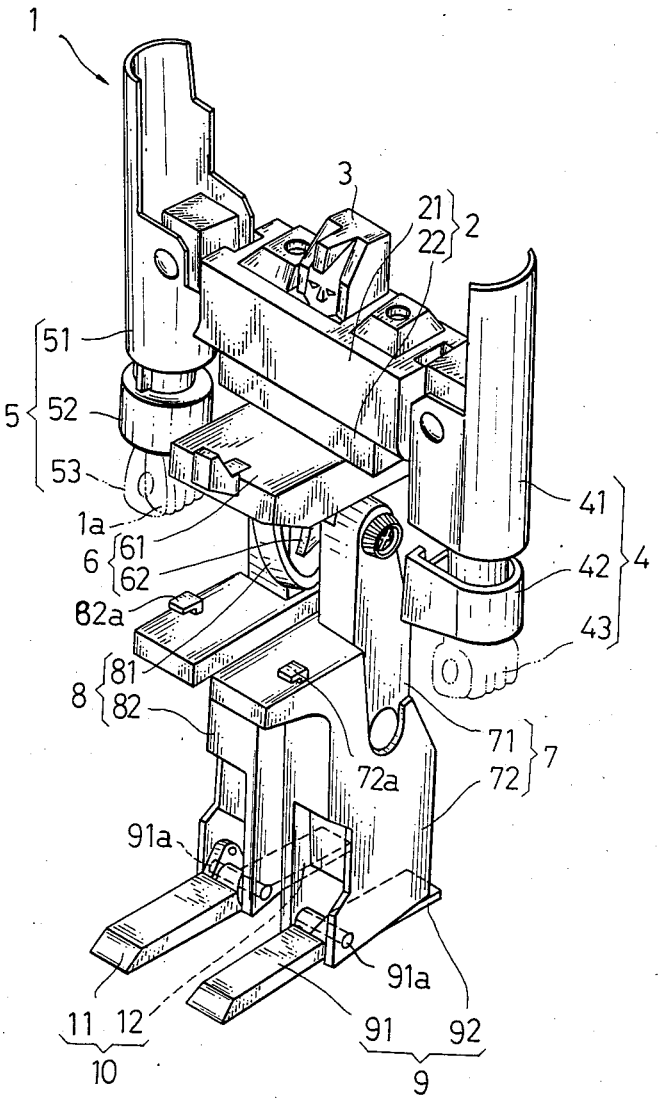
FIG. 4 is a perspective view of the configuration of the toy robotic humanoid formed by the embodiment of the present invention with the various parts thereof unfolded.

FIGS. 1 to 5 in combination show a toy pistol/robotic-humanoid assembly having a bullet-propelling apparatus which will be taken as one embodiment of the toy gun/robotic-humanoid assembly in accordance with the invention. A toy pistol/robotic-humanoid assembly 1 acting as a toy gun robotic-humanoid assembly is formed into a toy pistol in external appearance, as shown in FIG. 1, when all of the parts thereof is folded. On the other hand, when the parts are unfolded, the assembly is reconfigured into a toy robotic humanoid in external appearance, as shown in FIG. 4. Thus, the configuration of the assembly can be reversibly changed between the toy pistol and the toy robotic humanoid. Additionally, a toy pistol/robotic-humanoid assembly, which can be reversibly changed in configuration from a toy pistol formed by the assembly with the various parts thereof folded to a toy robotic humanoid formed by the assembly with the various parts thereof unfolded, is constructed such that a bullet can be propelled by operating a trigger lever when the assembly is in the form of the toy pistol, and by operating a locking lever when the assembly is in the form of the toy robotic humanoid.

The toy pistol/robotic-humanoid assembly 1 comprises, as shown in FIGS. 1 to 5: a trunk 2; a head 3 provided at the upper end of the trunk 2; left and right arms 4, 5 pivotally mounted on the left and right sides of the trunk 2, respectively; a waist unit 6 pivotally provided at the lower end of the trunk 2; left and right legs 7, 8 pivotally attached to the lower end of the waist unit 6; and a pair of feet 9, 10 pivotally provided at the lower ends of the legs 7, 8, respectively.

The trunk 2 is composed of a trunk body 21 which constitutes the central, gunbarrel portion of the toy pistol when the assembly is folded, and a stay 22 which is slidably fitted into the lower part of the trunk body 21. The head 3 is formed so as to have the shape of the head of the toy robotic humanoid and is arranged so that it is housed in the trunk body 21 when the assembly is folded, and is forced from the upper end of the trunk body 21 when the asembly is unfolded by means of the resilient force of a spring. The left and right arms 4, 5 are composed of: left and right upper arm portions 41, 51 which are attached to the left and right sides of the trunk body 21, respectively, so as to be able to pivot vertically left ward and rightward as well as rotate vertically forward and backward, and which have upper-half parts that cover the upper surface of the trunk body 21 when the assembly is folded; left and right forearm portions 42, 52 slidably provided at the ends of the upper arm portions 41, 51, respectively; and left and right hands 43, 53 which are detachably provided at the ends of the forearm portions 42, 52, respectively. The left and right arms 4, 5 constitute the front and rear portions of the gunbarrel of the toy pistol when the assembly is folded. A muzzle 52*a* is bored through the center of the front end of the forearm 52 so that a toy bullet 1*a* can fit therein. The waist unit 6 is composed of: a waist body 61 provided the lower side of the stay 22 so that it can pivot the truck body 21 horizontally and which is formed into the shape of a frame constituting a trigger-mounting frame for the toy pistol when the assembly is folded; and a trigger device 62 which is movably provided in the frame constituted by the waist body 61 and which constitutes the trigger of the toy pistol when the assembly is folded. The left and right legs 7, 8 are composed of: left and right upper leg portions 71, 81 provided on the lower end of the waist body 61 so that they can pivot horizontally and vertically forward and backward; and left and right lower leg portions 72, 82 which are slidably provided on the upper leg portions 71, 81 so that they can be extended along the upper leg portions 71, 81, respectively. The legs 7, 8 in combination constitute the grip of the toy pistol when the assembly is folded. The lower leg portions 72, 82 engage with the forearm portion 42 by engagement members 72*a*, 82*a*, respectively, as shown in FIG. 1. The left and right feet 9, 10 are composed of: left and right toe portions 91, 11 which are provided at the lower front corners of the left and right lower leg portions 72, 82, respectively, on pins 91*a* so that they can pivot vertically forward and backward and be folded into the vertical sides of the lower leg portions 72, 82, respectively, when the assembly is folded; and left and right heel portions 92, 12 which are provided on the left and right lower leg portions 72, 82, respectively, on the pins 91*a* which are also used by the toe portions 91, 11, respectively, so that they can pivot vertically forward and backward and be folded into the undersides of the lower leg portions 72, 82, respectively, when the assembly is folded. The feet 9, 10 together constitute the peripheral sides of the grip of the toy pistol when the assembly is folded.

Referring to FIGS. 2 and 3, a bullet-propelling apparatus 13 comprises: the trigger device 62 which is operated to propel the toy bullet 1*a*; a lever device 54 which locks the toy bullet 1*a* so that the bullet 1*a* can be propelled by an external operation; and an interlocking device 63 which is adapted to propel the toy bullet 1*a* by actuating the lever device 54 while interlocking with the trigger device 62.

The trigger device 62 is composed of: a trigger shaft 62*a* secured to the waist body 61; and a trigger lever 62*b* of which the lower half portion projects outwardly, and which is provided on the trigger shaft 62*a* so that it can pivot vertically forward and backward. The lever device 54 is composed of: a lever shaft 55 secured to part of the forearm portion 52 close to the upper arm portion 51; a locking lever 56 adapted to lock the toy bullet 1*a* and which is provided on the lever shaft 55 so that it can pivot vertically forward and backward within the forearm portion 52; and a lever spring 57 of which one end is retained by the locking lever 56 and which is provided so that it urges the toy bullet 1*a* in the direction in which it is propelled. The locking lever 56 is formed as a bent plate which has: a base portion 56*a* of a substantially C-shaped cross-section for retaining the lever spring 57; a hook-shaped locking portion 56*b* adapted to lock the toy bullet 1*a* and which extends forward from the upper part of the base portion 56*a*; and a projection 56*c* provided on the upper part of the base portion 56*a* so as to extend outward beyond the upper part of the forearm portion 52. The interlocking device 63 is composed of: a thin, round trigger rod 63*a* provided so that it can slide forward and backward while in contact with the front end part of the trigger lever 62*b* which is above the trigger shaft 62*a*; a substantially stair-shaped trigger arm 63*b* provided so that it can slide forward and backward with its rear end against the front end of the trigger rod 63*a*; a trigger spring 63*c* wound around the periphery of the trigger rod 63*a* between a spring seat 61*a* formed on an inner front part of the waist body 61 and the trigger lever 62*b* so as to urge the trigger lever 62*b* in the clockwise direction; and a thin, round, rod-shaped trigger piston 63*d* provided so that it can slide forward and backward with its ends against the front end of the trigger arm 63*b* and the rear surface of the locking lever 56, respectively.

Figure 5:
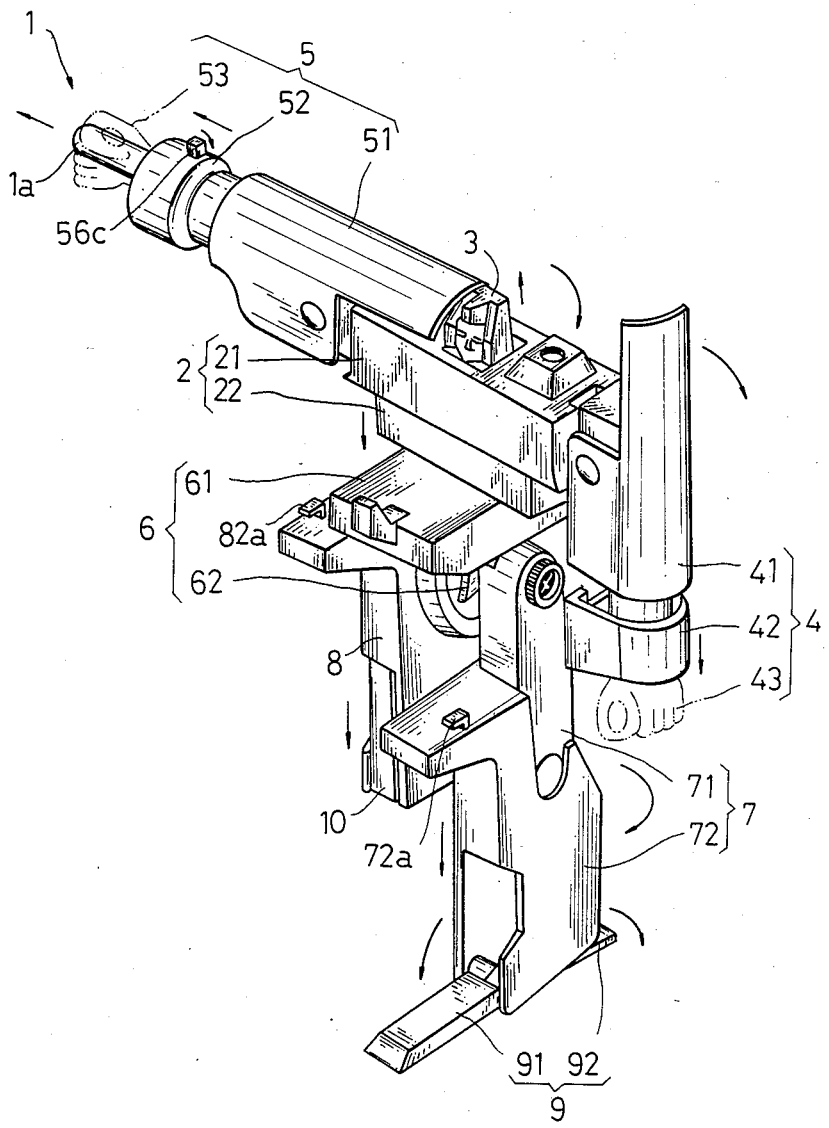
FIG. 5 is a perspective view of the embodiment while being reconfigured from the toy gun formed by the embodiment with the various parts thereof folded, to the toy robotic humanoid formed by the embodiment with the various parts thereof unfolded.

The operation of the toy pistol/robotic-humanoid assembly having a bullet-propelling apparatus will be described hereinunder:

The toy pistol/robotic-humanoid assembly 1 when in the shape of a toy pistol, with the various parts thereof folded as shown in FIG. 1, can be reconfigured into the shape of the toy robotic humanoid, as shown in FIG. 4, by successively unfolding the parts, as shown in FIG. 5.

Figure 6:
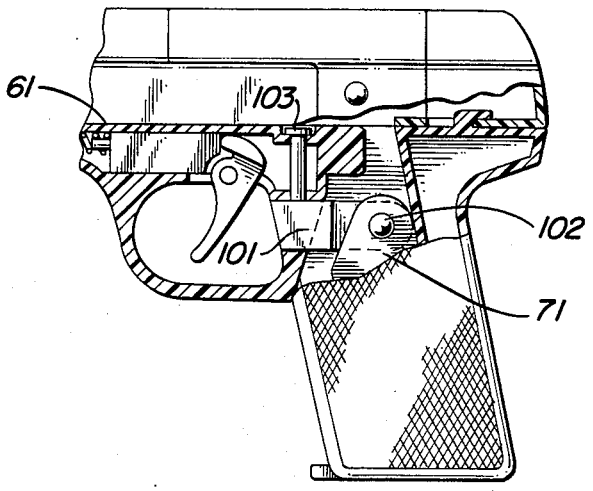
FIG. 6 is a partial sectional view taken parallel to the longitudinal section of FIG. 3.

First of all, the toy pistol/robotic-humanoid assembly 1 in the form of a toy pistol, with the various parts thereof folded as shown in FIG. 1, is unfolded. More specifically, as shown in FIG. 5, the left and right forearm portions 42, 52 are slid outward with respect to the upper arm portions 41, 51, respectively, to release the vertical engagement between the left and right lower leg portions 72, 82 and the forearm portion 42. Then, as shown in FIG. 5, the stay 22 is slid downward with respect to the trunk body 21 to extend the trunk 2 and thereby release the horizontal engagement between the lower leg portions 72, 82 and the forearm portion 42. Subsequently, the trunk 2, together with the arms 4, 5, is rotated clockwise through 90° with respect to the waist unit 6 so as to cross the waist unit 6 at right angles. The left and right lower leg portions 72, 82 are slid downward with respect to the left and right upper leg portions 71, 81 to extend the left and right legs 7, 8 so that the legs 7, 8 can pivot horizontally and vertically forward and backward. Then the left and right legs 7, 8 are rotated through 180° horizontally forward so as to be reversed parallel to each other. Referring to FIG. 6 a pivot arm 101 is connected through a pin 102 to the upper leg portion 71. An equivalent pivot arm and pin that operates in the same manner is connected to the upper leg portion 81, though not show herein. The pivot arm 101 includes a pin 103 that is rotataby connected to the waistbody 61. This pin 103 can rotate relative to the waistbody 61 to permit the leg 7, when in the extended condition, to pivot horizontally and vertically forward from the view shown in FIG. 6. Referring to FIG. 4, the other side of the pin 102 and the pivot arm 101 is shown rotated to the forward position. FIG. 6 shows the arm 101 rotated to the backward position. Subsequently, the left and right upper arm portions 41, 51, together with the forearm portions 42, 52, are rotated through 90° vertically downward so that each crosses the trunk 2 at right angles, to form a substantially channel-like shape in combination. While this happens, the head 3 is released from its engagement with the upper arm portions 41, 51 as the upper arm portions 41, 51 rotate, and is therefore moved upward by the resilient force of the spring to project beyond the upper surface of the trunk 2 and allow the greater part of its face to appear. Then left and right hands 43, 53 are fitted and locked into the lower ends of the forearm portions 42, 52 to form the arms 4, 5, respectively. The left and right toe portions 91, 11 are each rotated vertically forward about the pins 91*a*, and the left and right heel portions 92, 12 are also each rotated vertically downward about the pins 91*a*, so that the heel portions 92, 12 and the toe portions 91, 11 are on the respective horizontal straight lines, to form left and right feet 9, 10.

Thus the various parts of the toy pistol/robotic-humanoid assembly in the shape of the toy pistol are unfolded to reconfigure the assembly into a toy robotic humanoid shown in FIG. 4.

Meanwhile, the bullet-propelling apparatus 13 is adapted to be able to propel the toy bullet 1*a* when the assembly is either in the form of the toy pistol or in the form of the toy robotic humanoid.

More specifically, when the assembly is in the form of the toy pistol, as shown in FIGS. 2 and 3, a finger is placed on the trigger lever 62*b* to pivot it counterclockwise. In consequence, the trigger piston 63*d* is slid forward by the trigger rod 63*a* and the trigger arm 63*b*, causing the locking lever 56 to pivot clockwise about the lever shaft 55. As a result, the locking of the toy bullet 1*a* by the locking portion 56*b* of the locking lever 56 is released, so that the toy bullet 1*a* is propelled toward the target by the resilient force of the lever spring 57.

On the other hand, when the assembly is in the form of the toy robotic humanoid, as shown in FIG. 4, the interlocking device 63 and the lever device 54 are not linked to each other. For this reason, the toy bullet 1*a* cannot be propelled by the operation of the trigger lever 62*b*; so the lock lever 56 can be directly operated to allow the toy bullet 1*a* to be propelled. More specifically, pivoting the projection 56*c* rearward (clockwise) undoes the locking of the toy bullet 1*a* by the locking portion 56*b*, to allow the toy bullet 1*a* to be propelled toward the target by the resilient force of the lever spring 57.

Thus it is possible to propel the toy bullet 1*a* toward the target by operating the trigger lever 62*b* when the assembly is in the form of the toy gun, as shown in FIG. 1; or by directly operating the locking lever 56 when the assembly is in the form of the toy robotic humanoid, as shown in FIG. 4.

After the toy bullet 1*a* has been propelled as described above, the trigger lever 62*b* is returned to its former position by a clockwise pivotal force by the resilient force of the trigger spring 63*c*.

When loading the toy bullet 1*a*, fitting the toy bullet 1*a* into the muzzle 52*a* enables a lock between the toy bullet 1*a* and the locking portion 56*b* of the locking lever 56, thereby allowing the toy bullet 1*a* to be loaded into the toy pistol/robotic-humanoid assembly 1.

It is to be noted that the toy pistol/robotic-humanoid assembly, when in the shape of the toy robotic humanoid, can be reconfigured into the shape of the toy pistol, as shown in FIG. 1, by folding the various parts thereof in the reverse order to that above. In other words, it is possible to effect a reversible change in configuration between the toy pistol formed by the assembly with the various parts thereof folded, and the toy robotic humanoid formed by the assembly with the various parts thereof unfolded.

It is also to be noted that the configuration of the toy gun including the toy bullet-propelling apparatus in accordance with the invention is not limited to that of the pistol type of gun in accordance with the above embodiment, and may be that of a rifle, machine gun or other type of gun, although these are not shown. In addition, the toy robotic humanoid in accordance with the invention is not limited to the non-powered type of toy robotic humanoid in accordance with the above embodiment, and may be powered, although this is not shown. Moreover, the toy robotic humanoid may have other accessories, such as a gun or the like, as required.

The invention with the above construction offers the following practical advantages:

(1) The toy gun/robotic-humanoid assembly is extremely surprising and very interesting, since the assembly effects a remarkable, totally unexpected change in configuration from the shape of a toy gun formed with the various parts of the assembly folded, to the shape of a toy robotic humanoid formed with the various parts of the assembly unfolded.

(2) The operation is simple, since each of the constituent parts can be folded and unfolded simply by rotating and sliding them, and therefore there is no need for attaching or detaching each part.

(3) Since the constituent parts are connected to each other so that they can be folded and unfolded as desired, there is no possibility that individual parts can come off or be lost. In addition, by folding and unfolding the constituent parts, it is possible to effect a complicated change in configuration, so very advanced block play is possible.

(4) The toy gun/robotic-humanoid assembly is extremely surprising and very interesting, since the assembly is able to propel the toy bullet even when it is in the form of the toy robotic humanoid with the various parts of the assembly unfolded, as well as when it is in the form of the toy gun with the various parts of the assembly folded.

(5) Since the toy bullet can be propelled either when the assembly is folded to form the toy gun or when the assembly is unfolded to form the toy robotic humanoid, range of play of the bullet-propelling assembly is very wide.

(6) Since the assembly and the bullet-propelling apparatus has a simple structure but a large change in configuration obtained when folded or unfolded, its manufacture is easy, and its cost low.

What is claimed is:

1. A combination toy gun and robotic-humanoid assembly that can be reconfigured from one configuration to another configuration at the option of the user comprising:

a handle member;

a gun barrel member movably mounted above the handle member;

a trigger assembly positioned adjacent the handle member and beneath the gun barrel member, the handle member, gun barrel member and trigger assembly being permanently and movably connected together and simulating the configuration of a gun in a first position; and a robotic head member connected to the gun barrel member, the handle member being configured to simulate the robotic legs of a humanoid robot when moved to a second position, and at least a portion of the gun barrel member being configured to simulate a robotic arm of a humanoid robot when moved to a second position with the robotic head positioned adjacent the robot arm and above the robotic legs wherein a toy robotic humanoid assembly can be provided in the second position by reconfiguration of the toy gun configuration.

2. A toy gun/robotic-humanoid assembly comprising:

a trunk of the toy robotic humanoid which also constitutes the central portion of a gunbarrel of the toy gun when the assembly is folded;

a head of the toy robotic humanoid which is provided on the upper side of the trunk and is housed within the trunk when the assembly is folded;

right and left arms of the toy robotic humanoid which are rotatably and extendably mounted on the right and left sides of the trunk and constitutes the front and rear portions of the gunbarrel of the toy gun, respectively, when the assembly is folded;

a waist unit of the toy robotic humanoid which is pivotally provided at the lower end of the trunk and constitutes a trigger portion of the toy gun when the assembly is folded;

right and left legs of the toy robotic humanoid which are pivotally mounted on the lower end of the waist unit and constitutes a grip of the toy gun when the assembly is folded; and a pair of feet of the toy robotic humanoid which are pivotally provided at each lower end of the legs and are folded into the grip of the toy gun when the assembly is folded;

wherein the toy gun/robotic-humanoid assembly forms a toy gun when folded and is reconfigured into a toy robotic humanoid when unfolded.

3. The invention of the claim 2 wherein one of the arms has a muzzle which is formed so that a toy bullet can fit therein, and a lever device which locks the toy bullet so that the bullet can be propelled by an external operation, and wherein an interlocking device actuates the lever device while interlocking with the trigger device, is provided between the lever device and trigger device.

4. A combination toy gun and robot assembly that can be reconfigured from one configuration to another configuration at the option of the user comprising:

a handle member;

a gun barrel member movably mounted above the handle member;

a trigger assembly positioned adjacent the handle member and beneath the gun barrel member, the handle member, gun barrel member and trigger assembly simulating the configuration of a gun in a first position, and a robotic head member connected to the gun barrel member, the handle member being configured to simulate the robotic legs of a humanoid robot when moved to a second position, and portions of the gun barrel member being configured to simulate the robotic arms of a humanoid robot when moved to a second position with the robotic head positioned adjacent the robotic arms and above the robotic legs wherein a toy robotic humanoid assembly can be provided in the second position by reconfiguration of the toy gun configuration.

5. The invention of claim 4 wherein the handle member is bifurcated into a pair of leg members.

6. The invention of claim 5 wherein each leg member includes a pivotal foot member that can be extended or retracted.

7. The invention of claim 5 wherein each leg member includes an upper and lower leg portion that is relatively slidable to enable one of a compact handle configuration and an extended robot leg configuration.

8. The invention of claim 7 wherein the upper leg portions are pivotally mounted adjacent the trigger assembly to permit rotation of the leg members wherein one side of each leg member has a gun handle configuration, while the other side provides a compatible robotic configuration.

9. The invention of claim 4 wherein the gun barrel member can be bifurcated to provide the respective robotic arms.

10. The invention of claim 9 wherein the bifurcated portions of the gun barrel member are pivotally connected to permit rotation to simulate the positioning of robotic arms.

11. The invention of claim 4 wherein the robotic head is mounted adjacent the gun barrel member.

12. The invention of claim 4 further including a spring member mounted in the gun barrel member, a locking lever mounted to restrain the spring member when compressed and a trigger rod which interconnects the locking lever with the trigger assembly to permit a user to release the spring member wherein a projectile can be shot by the spring member from the gun configuration.

13. The invention of claim 12 wherein a portion of the locking lever extends externally of the gun barrel member and can be activated to release the spring member independent of the trigger assembly in a toy robot configuration to also release a projectile.

14. The invention of claim 11 wherein the robotic head is spring biased and is mounted to be held in a biased position by the gun barrel member.

15. The invention of claim 4 wherein the handle member, gun barrel member and trigger assembly are configured to simulate a Browning M 1910 pistol in the first position.

16. A combination toy gun and robot assembly that can be reconfigured from one configuration to another configuration at the option of the user comprising:

a handle member;

a gun barrel member having a longitudinal axis movably mounted above the handle member;

a trigger assembly positioned adjacent the handle member and beneath the gun barrel member, the handle member, gun barrel member and trigger assembly simulating the configuration of a gun in a first position, the trigger assembly and handle member being pivotally connected to a portion of the gun barrel member and rotatably about an axis traverse to the longitudinal axis of the gun barrel member, and a robotic head member connected to the gun barrel member, the handle member being configured to bifurcate into a first and second robotic leg of a humanoid robot when pivoted to a second position, and portions of the gun barrel member being configured to simulate the robotic arms of a humanoid robot when moved to a second position with the robotic head positioned adjacent the robotic arms and above the robotic legs wherein a toy robotic humanoid assembly can be provided in the second position by reconfiguration of the toy gun configuration.

17. The invention of claim 16 wherein the gun barrel member is bifurcated into a first and second member to provide the respective robotic arms.

18. The invention of claim 17 wherein the birfurcated first and second arm members are pivotally connected to permit rotation to simulate the positioning of robotic arms.

19. The invention of claim 18 wherein each leg member includes a pivoted foot member.

20. The invention of claim 18 further including a spring member mounted in the gun barrel member, a locking lever mounted to restrain the spring member when compressed and a trigger rod which interconnects the locking lever with the trigger assembly to permit a user to release the spring member wherein a projectile can be shot by the spring member from the gun configuration.

* * * * *